US006708391B2

(12) United States Patent
Yamakage et al.

(10) Patent No.: US 6,708,391 B2
(45) Date of Patent: Mar. 23, 2004

(54) MAGNET AND MAGNETIC SENSOR

(75) Inventors: Hirokazu Yamakage, Takefu (JP); Hisanori Niwamoto, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/166,593

(22) Filed: Jun. 12, 2002

(65) Prior Publication Data

US 2002/0196115 A1 Dec. 26, 2002

(30) Foreign Application Priority Data

Jun. 12, 2001 (JP) ..... 2001-176484

(51) Int. Cl.[7] ..... H01F 7/06; H01F 1/03
(52) U.S. Cl. ..... 29/608; 335/302
(58) Field of Search ..... 335/296–306; 148/100, 101, 105; 264/611, 612; 29/607, 608; 324/207.11–207.26

(56) References Cited

U.S. PATENT DOCUMENTS 6,423,264 B1 * 7/2002 Gay ..... 264/611
6,429,647 B1 * 8/2002 Nicholson ..... 324/207.2

* cited by examiner

*Primary Examiner*—Ramon M. Barrera
(74) *Attorney, Agent, or Firm*—Foley & Lardner

(57) ABSTRACT

The present invention provides magnets having a metallic pin mounted therein with high bond strength and with high reliability and exhibiting good productivity. It also provides magnets in which the bond strength of the metallic pin remains high even at high temperatures or in organic solvents. Specifically, the present invention relates to a magnet having a metallic pin mounted therein without using an adhesive, and this magnet can be made by sintering the magnet and the metallic pin at the same time.

3 Claims, 1 Drawing Sheet

MAGNET AND MAGNETIC SENSOR

BACKGROUND OF THE INVENTION

1. Field of the Invention

This invention relates to sintered magnets for use in magnetic sensors and to magnetic sensors.

2. Description of the Related Art

Conventionally, there have been used ring magnets in which a metallic pin is mounted with the aid of an adhesive in order to control the magnetic field. Although the presence of a pin in the bore of a ring magnet makes it possible to control the magnetic field, the interposition of an adhesive between the ring magnet and the metallic pin requires troublesome operations, and an uneven distribution of the adhesive is very likely to cause variations in bond strength. Moreover, a recent tendency is to use such ring magnets frequently at high temperatures. Higher temperatures cause a reduction in bond strength, resulting in a lack of thermal resistance.

Furthermore, the use of adhesives such as epoxy and phenolic adhesives enables a pin to be mounted in a magnet. However, a reduction in bond strength has been found to occur in organic solvents.

SUMMARY OF THE INVENTION

The present invention provides magnets in which the bond strength of a metallic pin within the magnet is high especially at high temperatures, the magnets scarcely undergoes deterioration by solvents, and the process steps for the production of the magnets can be simplified and hence bring about an improvement in productivity.

In view of the above-described problems, the present invention comprises a magnet made by mounting a metallic pin therein without using an adhesive. That is, the above-described problems can be solved by sintering the magnet and the metallic pin at the same time.

According to the present invention, the metallic pin inserted in the magnet has high thermal resistance and high bond strength, and the sign of the magnetic field can be changed to provide a highly sensitive magnetic sensor.

DETAILED DESCRIPTION OF THE PREFERRED EMBODIMENTS

Figure 1:
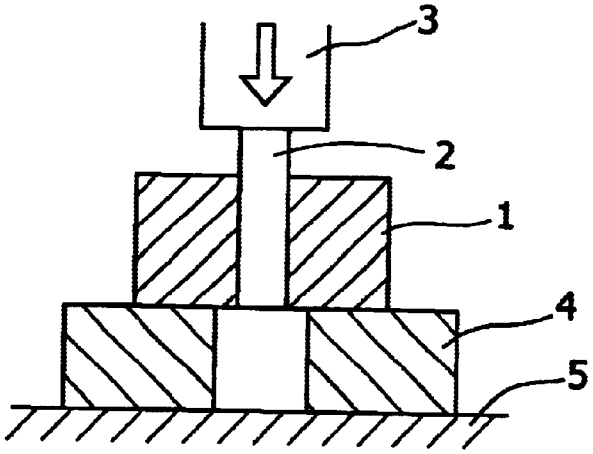
FIG. 1 is a sectional view illustrating an evaluation method for the measurement of bond strength.

No particular limitation is placed on the shape and composition of the magnet used in the present invention, provided that it comprises a compact which is suitable for the formation of a sintered magnet and is configured to have a hole for receiving a metallic pin. However, it is especially preferable to use a ring magnet designed to control the magnetic field.

The shape of the magnet may be such that it has a bore conforming to the shape of a metallic pin. The magnet used in the present invention preferably comprises a compact formed of a sintering alloy selected from R—T—B (in which R is a rare earth element, inclusive of Y, and T is a transition metal; e.g., $Nd_2Fe_{14}B$), R—T (e.g., $Sm_2Co_{17}$) and R—T—N alloys.

The metallic pin may comprise a columnar body formed of a magnetic material permitting magnetic field control, such as pure iron, SUS or a cemented carbide (e.g., WC). The shape of the metallic pin may be cylindrical or prismatic. With consideration for thermal contraction, it is preferable to use a metallic pin having an outside diameter equal to 70–90 sq. % of the inside diameter of the magnet before sintering.

The magnet may be made according to any commonly employed process. For example, an alloy prepared by any conventional method such as casting, roll quenching or atomization is reduced (e.g, by pulverization) to a powder having an average particle diameter of 1 to 30 $\mu$m. In the case of a ring magnet, this alloy powder is packed into a ring-shaped mold and compacted in a magnetic field so as to form a conventional magnet.

Then, a metallic pin is inserted into the center of the compact so formed (e.g., into the bore of a ring magnet), and this assembly is preferably sintered at a temperature of 900 to 1,400° C. in an inert atmosphere, for example, of argon. Moreover, the resulting magnet may be aged at a temperature of 500 to 1,100° C.

The sintered magnet so made has few interstices and undergoes only a slight reduction in bond strength even when exposed to high temperatures.

Furthermore, the magnet can be cut or otherwise machined, and used in a magnetic sensor.

A preferred example of a magnetic sensor in accordance with the present invention is a magnetic sensor in which a magnet having a metallic pin mounted therein as described above and an iron material (magnetic material) are positioned with a gap left therebetween and a magnetic field detection device is interposed therebetween.

With this magnetic sensor, the iron material can be moved horizontally and vertically while the magnet and the magnetic field detection device remain stationary. Movement of the iron material causes a change in the magnetic field value detected by the magnetic field detection device, so that variations of the iron material can be detected by differences in magnetic field value.

Especially when a magnet having a metallic pin mounted therein according to the present invention is used, it is possible to construct a magnetic sensor having such high sensitivity that a large difference in magnetic field value can be read and, moreover, the sign (N/S) of the detected magnetic field can be changed.

EXAMPLE 1

A metallic pin (free-cutting steel SUM24; 1.6 mm in diameter and 7 mm in height) was inserted into a compact formed in a magnetic field ($Sm_2CO_{17}$ magnet; R22HA manufactured by Shin-Etsu Chemical Co., Ltd.; machined to measure 9.5 mm in outside diameter, 1.97 mm in inside diameter and 6 mm in height). This assembly was sintered at 1,200° C. for 3 hours in an atmosphere of argon gas.

The bond strength of the metallic pin was measured in the following manner. As illustrated in FIG. 1, magnet 1 having metallic pin 2 mounted therein was placed on a jig 4 resting on a pedestal 5. Then, using a pressure head 3, a downward pressure was applied to the pin projecting from the magnet. Thus, the maximum load before causing the pin to be removed was examined. The results of load measurements are shown in Table 1. Moreover, a specimen was soaked in acetone for 1,000 hours and the bond strength of the pin was measured in the same manner as described above. The degree of deterioration was calculated as a percent loss in bond strength as compared with an unsoaked specimen. The results are shown in Table 2.

TABLE 1

| Temperature (° C.) | Bond strength of pin (maximum load before causing pin to be removed) | |
|---|---|---|
| | Magnet having a sintered pin (kgf) | Magnet having an adhesive-bonded pin (kgf) |
| 20 | 153 | 96 |
| 100 | 161 | 81 |
| 200 | 142 | 53 |
| 300 | 165 | 25 |

TABLE 2

| | Bond strength of pin | | Degree of |
|---|---|---|---|
| | Before soaking (kgf) | After 1,000 hours' soaking (kgf) | deterioration in strength (%) |
| Example 1 | 155 | 153 | 1 |
| Comparative Example 1 | 96 | 70 | 27 |

COMPARATIVE EXAMPLE 1

A metallic pin similar to that used in Example 1 was coated with an epoxy adhesive so as to give a cured thickness of 200 $\mu$m. This pin was inserted into a sintered body obtained by sintering a compact formed in a magnetic field ($Sm_2Co_{17}$ magnet; R22HA manufactured by Shin-Etsu Chemical Co., Ltd.; machined to measure 9.5 mm in outside diameter, 1.97 mm in inside diameter and 6 mm in height) at 1,200° C. for 3 hours, and then heated at 120° C. to cure the adhesive. Similarly to Example 1, the magnet so made was soaked in acetone and the bond strength of the pin was measured. The results are shown in Table 2.

APPLICATION EXAMPLE

Figure 2:
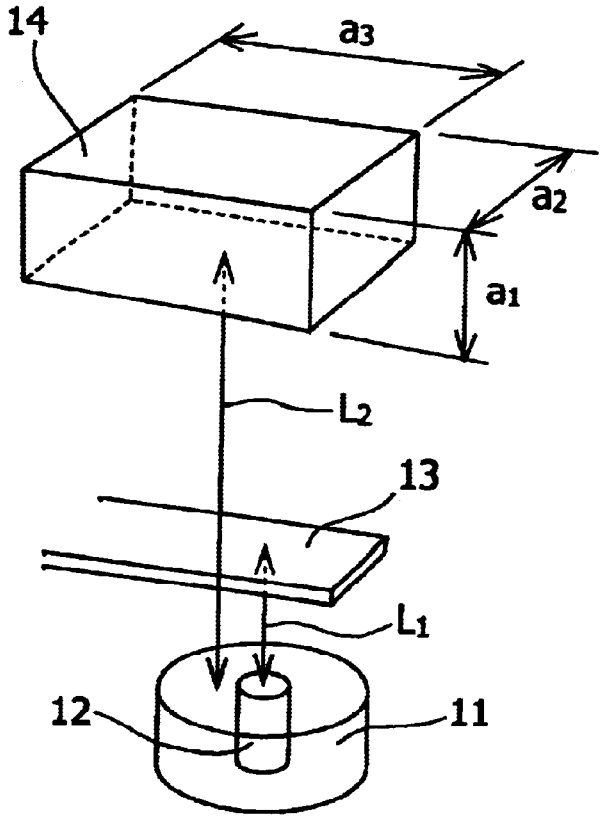
FIG. 2 is a view of an exemplary magnetic sensor used in the Application Example which will be given later.

An example of a magnetic sensor is illustrated in FIG. 2. The magnet of Example 1 was cut to have an outside diameter of 7.7 mm and a height of 5 mm, so that there was obtained a magnet 11 having a pin 12. A Hall device 13 was positioned with a gap $L_1$ of 0.66 mm left between the center of magnet 11 and Hall device 13. Moreover, a piece of iron 14 ($a_1$=5 mm, $a_2$=5 mm, $a_3$=13 mm) was positioned with a gap $L_2$ of 1.5 mm or 6.5 mm left between the center of magnet 11 and piece of iron 14. Then, the value of the magnetic field (i.e., the value of the Hall device) was measured. The results of measurements are shown in Table 3.

TABLE 3

| | Magnetic field value (value of Hall device) | | Difference in magnetic field value |
|---|---|---|---|
| | $L_2$ = 1.5 mm (G) | $L_2$ = 6.5 mm (G) | [(1.5 mm value) − (6.5 mm value)] (G) |
| Example 1 | 458 | −493 | 951 |

With the ring magnet of the present invention, a larger difference is obtained between the magnetic field values before and after movement of the piece of iron. Moreover, the signs of the magnetic poles (N/S) can be reversed to change the sign of the magnetic field. With the magnet having no pin inserted therein, the difference in magnetic field value is smaller and the sign of the magnetic field does not change. Consequently, this indicates that a ring magnet gives a greater change in magnetic flux and can hence provide a highly sensitive magnetic sensor.

What is claimed is:

1. A method of making a ring magnet comprising inserting a metallic pin having an outside diameter equal to 70–90 sq. % of an inside diameter of magnet before sintering into a compact of the magnet, and sintering the magnet with the metallic pin at 900 to 1400° C.

2. The method of making a ring magnet according to claim 1 wherein said sintering is carried out in an inert atmosphere.

3. The method of making a ring magnet according to claim 1, further comprising aging the sintered magnet at 500 to 1100° C.

* * * * *